US006298995B1

(12) United States Patent
Schwester

(10) Patent No.: US 6,298,995 B1
(45) Date of Patent: Oct. 9, 2001

(54) ONE-PIECE INNER PACKAGE

(75) Inventor: Charles P. Schwester, Kinnelon, NJ (US)

(73) Assignee: Package Development Company, Rockaway, NJ (US)

( * ) Notice: Subject to any disclaimer, the term of this patent is extended or adjusted under 35 U.S.C. 154(b) by 0 days.

(21) Appl. No.: 09/441,796

(22) Filed: Nov. 17, 1999

(51) Int. Cl.[7] ..... B65D 81/02
(52) U.S. Cl. ..... 206/779; 206/277; 206/485
(58) Field of Search ..... 206/277, 461–471, 206/485, 779, 780

(56) References Cited

U.S. PATENT DOCUMENTS 3,203,542 * 8/1965 Lightner et al. ..... 206/779
3,887,067 * 6/1975 Collura et al. ..... 206/780
3,901,382 * 8/1975 Roccaforte ..... 206/779
3,934,719 * 1/1976 Roccaforte ..... 206/779
4,146,128 * 3/1979 Hogg et al. ..... 208/776
4,201,294 * 5/1980 Roccaforte ..... 206/780
4,899,877 * 2/1990 Kiernan ..... 206/471
5,279,417 * 1/1994 Seaton ..... 206/461
5,577,606 * 11/1996 Schwentuchowski et al. ..... 206/485
5,890,593 * 4/1999 Humphrey ..... 206/471

* cited by examiner

*Primary Examiner*—Jim Foster
(74) *Attorney, Agent, or Firm*—Kaplan & Gilman, L.L.P.

(57) ABSTRACT

A one-piece inner package is disclosed to be made from a single plate. A shoulder with a seat portion supports one end of the product, while an opening on a slope portion supports the other end of the product. Movement of the product inside the outer box is therefore prevented by the seat portion, the opening, as well as by a back wall of the outer box.

17 Claims, 3 Drawing Sheets

ONE-PIECE INNER PACKAGE

TECHNICAL FIELD

The present invention generally relates to packaging, more specifically, to a one-piece inner package for preventing a product to be packaged from moving inside an outer package or box.

BACKGROUND OF THE INVENTION

For purposes of displaying a product inside a box to potential consumers, a package box may be provided with an opening or window in its front so that the product can be seen through this window. The window is usually covered by a transparent film or plate made of, e.g., a plastic so as to prevent the product from being touched directly by the consumers. Due to the increasing requirements on recycling, the box is usually made of a recyclable material such as recyclable paper and a separate inner package. The inner package is made of a transparent material and usually of a plastic for its low cost. In order to prevent the product inside the box from moving, usually the inside plastic portion comprises two pieces together in a "clamshell" configuration. The clamshell includes a bottom part, sometimes molded as the shape of the product, for containing and supporting the product, and the other is a cover part for preventing the product leaving the bottom.

It is obvious that the cost for manufacturing the inner package will be substantially decreased if it is replaced by a one-piece item.

Prior attempts have focused around making a one piece plastic holder that is molded with an imprint of the item to be held. Thus, if a tube of ointment is to be held, the tube will sit snugly into a plastic imprint of the tube. Problematically, during shipping, the tube may come loose.

SUMMARY OF THE INVENTION

Therefore, one purpose of the present invention is to provide a one-piece inner package which can prevent the product to be packaged from movement inside an outer box.

The other purpose of the present invention is to provide a one-piece inner package which is easy to manufacture and convenient to use.

These purposes are achieved by the inner package of the present invention which comprises a plate made of transparent material. The plate has a shoulder portion, a middle portion and a base portion, with the shoulder portion and the base portion extend in opposite directions from the middle portion. The shoulder portion has a seat shaped to accommodate and support a first end of the product to be packaged, and when being packaged, the first end abuts a wall of the outer box. The middle portion includes a slope portion having an opening to accept a second end of the product. The base portion also helps to support the second end and prevent its movement. When being used, the second end of the product is inserted through the opening on the slope portion and rests on the base. The movement of the second end is prevented by the inner peripheral of the opening and by the base portion, while the movement of the first end of the product is prevented by the seat portion as well as by the wall of the outer box that it abuts. In this way, the product is kept stationary inside the outer box.

BRIEF DESCRIPTION OF THE DRAWINGS

The above and other advantages and features will be clearer by the following detailed descriptions of the preferred embodiments, with reference to the accompanying drawings in which:

FIG. 1(*b*) is the side view of the inner package in FIG. 1 (*a*);

FIG. 1(*c*) is a perspective view of the inner package of FIG. 1 to show the reverse side of the package, with the product separated therefrom;

DETAILED DESCRIPTION OF THE PREFERRED EMBODIMENT

Figure 1A:
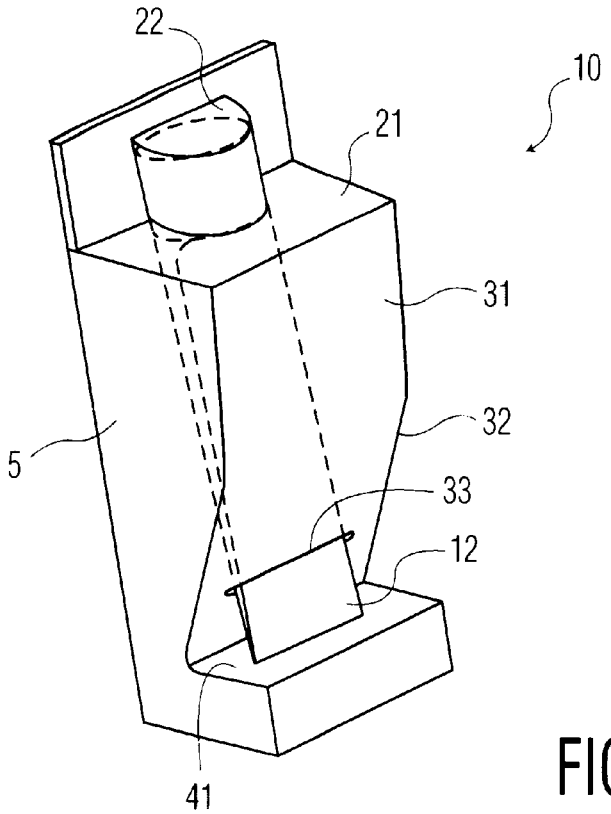
FIG. 1(*a*) is a perspective view of an embodiment of the inner package of the present invention, with a product to be packaged thereon.
Figure 1B:
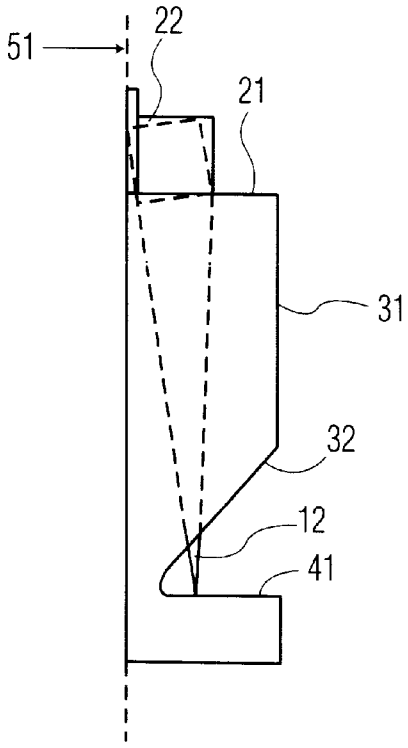
Figure 1C:
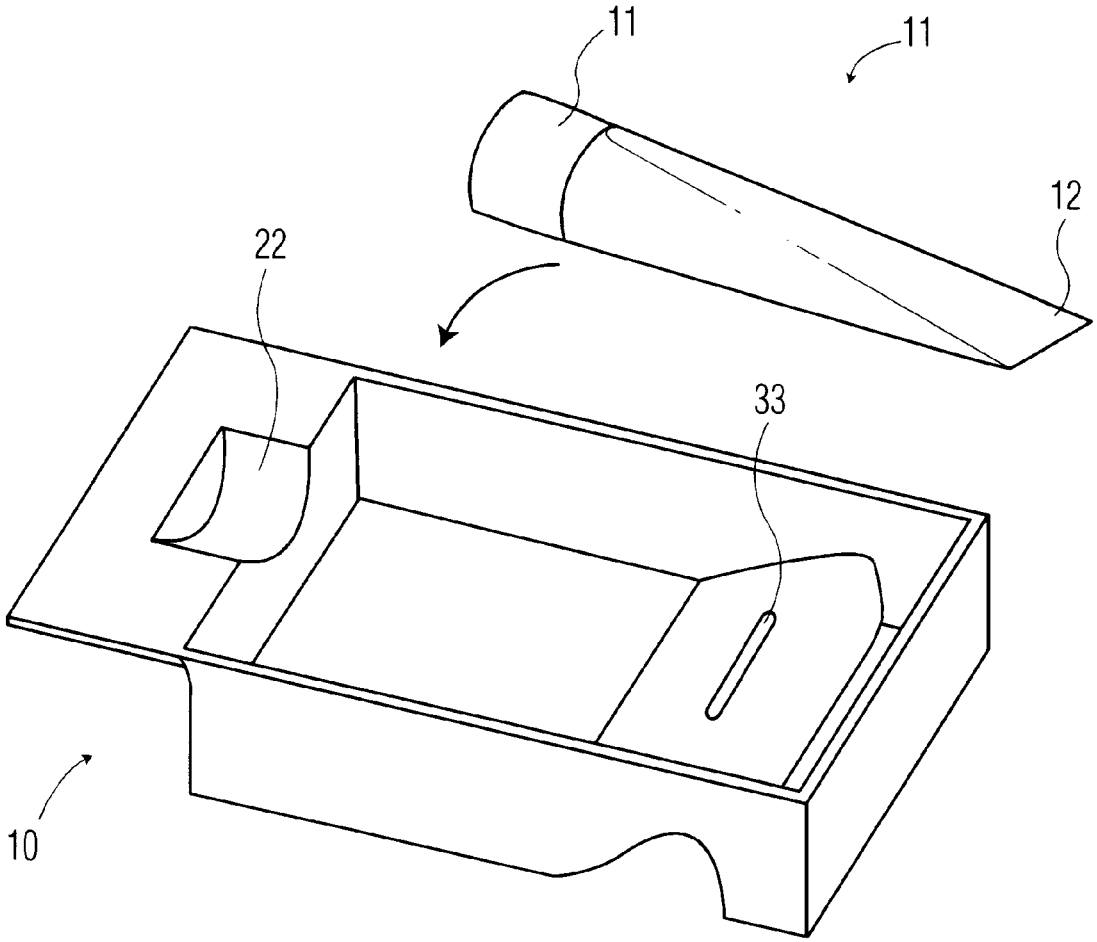

FIGS. 1(*a*)–1(*c*) shows a preferred embodiment of the inner package of the present invention, designated generally as 10. Preferably, the inner package 10 is made from a transparent plastic for the purpose of partially displaying a product 1 resting thereon when the inner package 10 is placed in an outer box with a display window. The inner package is a one-piece item manufactured from a plastic plate in a thermal forming that is a well known technique in the art. Other processes may be used as well.

The inner package 10 shown in FIG. 1 has a generally rectangular shape, suitable to be inserted in a rectangular outer box (not shown). The inner package 10 includes a top portion, a middle portion and a bottom portion, as well as two opposite side walls 5.

The top portion comprises a shoulder 21 substantially vertical to a plane 51. Top portion 2 also includes a seat portion 22 with a molded shape same to that of the top end 11 of the product 1 so that the top end 11 can be snapped in the seat portion 22. When the top end 11 of the product rests in the seat portion 22, the top end 11 also flushes with the plane 51 so that, after the inner box 10 with the product 1 is placed into the outer box, the top end 11 abuts the inside surface of a wall (usually is the back wall) of the outer box. In such a way, the movement in any directions of the top end 11 is prevented, either by the seat portion or by the back wall of the outer box.

The middle portion includes a plane portion 31 which is parallel to the plane 51 and a slope portion 32 which is inclined from the plane portion 31 toward the plane 51. A slot 33 is formed in the slope portion 32, through which the bottom end 12 of the product 1 is inserted. The inner peripheral of slot 33 prevents the bottom end 12 from movement in any peripherical direction.

The bottom portion of the package 10 has a base portion 41 which extends parallel to shoulder 21, but in an opposite direction related to the middle portion 31. In other words, the shoulder 21 and the base 41 bend in opposite directions from the middle portion. The base 41 prevents the bottom end 12 from movement along the longitudinal direction of the product.

Figure 2:
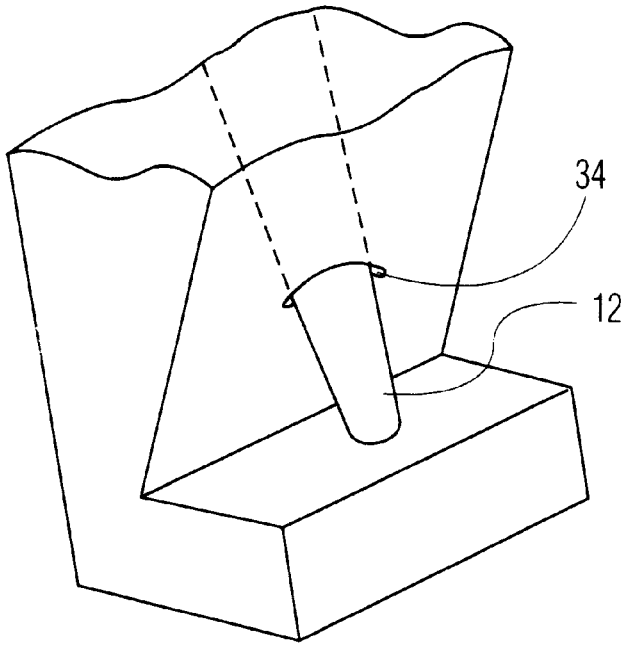
FIG. 2 is a perspective view of a second embodiment of the inner package of the present invention.

The shape of the slot 33 in the slope 32 can be changed according to the shape of the bottom end 12 of the product. For example, FIG. 2 shows a second embodiment of the present invention in which the opening on the slope portion 32 is a round hole 33 instead of slot 33 in FIG. 1. This is suitable to accept an elongate round shaped or conical end of the product 1.

Figure 3:
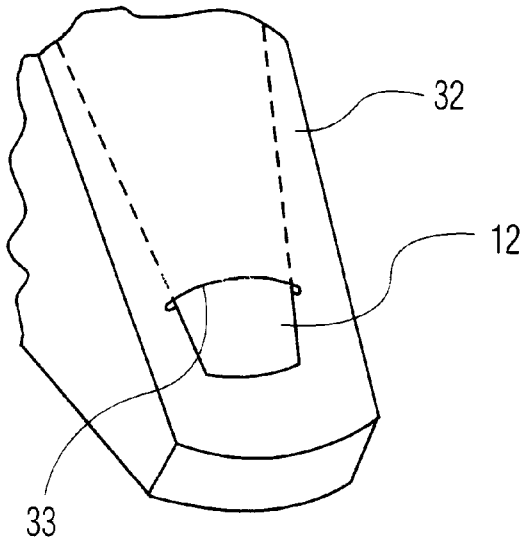
FIG. 3 is a perspective view of a third embodiment of the inner package of the present invention.

FIG. 3 shows a further embodiment of the present invention in which the bottom portion in FIGS. 1 and 2 is omitted.

The pledged shape of the bottom end of the product 1 in FIG. 3 prevents itself from moving further through the slot 33.

In manufacturing, the inner package 10, except the slot or hole 33 in it, may be produced in a single press thermal forming process, which is well know in the art. The slot or hole 33 can be formed in a subsequent punch process. There is no need to place a slope die to match the slope portion 32 if the inner package 10 is made of a resilient material. The hole may be made in other manners as well, including for example, punch and die. It will bend during the punch but will resume its shape after the punch.

Even though the inner package 10 of the present invention is best used in a situation where the product is desired to be shown from a window in the outer box, it can also be used for a box there is no such a need to show the product. In this situation, the inner package 10 still has its advantage in keeping the product stationary inside the outer box. Of course here it does not have to be made of a transparent material.

There are many modifications available to a person skilled in the art without departing of the spirit of the invention. For example, the plane portion 31 of the middle portion may be omitted if the product 1 is short. The seat portion 22 may be simplified as a slot on the shoulder 21 if the product 1 is light in weight. The two side walls 5 may also be omitted if the strength of inner package 10 is enough to support itself inside the outer box. All these modifications are deemed to be within the scope of the claims.

What is claimed is:

1. A packaging item for keeping a product inside a package box having a wall, said product having a first end and a second end, said packaging item comprising an one-piece plate having:

a shoulder portion and a slope portion assuming an acute angle with said shoulder portion;

said shoulder portion being formed with a seat having a flat portion open at a plane and having a shape and a size adapted to snugly accommodate said first end of said product such that, when said first end of said product is accommodated in said seat, said first end of said product is flush with said plane, and said slope portion having a hole formed therethrough to support said second end of said product inserted through said hole.

2. A packaging item as in claim 1 wherein said seat is molded in a shape of said first end of the product.

3. A package item as in claim 1 wherein said hole on said slope portion is a slot.

4. A package item as in claim 1 wherein said hole on said slope portion is substantially round.

5. A packaging item as in claim 1 wherein said plate further has a base portion for supporting said second end, said base portion assuming an acute angle with said slope portion, and said base portion and said shoulder extending from said slope portion in substantially opposite directions.

6. A package item as in claim 5 wherein said base portion is close to said hole.

7. A packaging item as in claim 1 wherein said plate further includes a flat portion between said shoulder portion and said slope portion.

8. A packaging item as in claim 1 wherein said plate further includes two side wall portions.

9. A package item as in claim 1 wherein said plate is made of a transparent resilient material.

10. A package item as in claim 9 wherein said material is a plastic.

11. An inner package for keeping a product stationary inside an outer box, wherein said outer box having a front with a display open window and a back, said product having a first end and a second end, said inner package being dimensioned to be unmovably fitted inside said box and comprising:

a transparent one-piece plate having a middle portion having a top end and a bottom end, including a slope portion having said bottom end, said slope portion further having a hole formed therethrough for accepting said second end of said product therethrough;

a top portion having a shoulder extending in a first direction from said top end to a first end edge and a seat for supporting said first end of said product, said seat having a flat portion open at a plane and having a shape and a size adapted to snugly accommodate said first end of said product such that, when said first end of said product is accommodated in said seat, said first end of said product is flush with said plane; and a bottom portion having a base extending from said bottom end in a second direction generally opposite to said first direction for supporting said second end of said product protruding through said opening on said slope portion.

12. An inner package as in claim 11 wherein said seat is molded in a shape of said first end of the product such that said first end of said product can snugly rest thereon.

13. An inner package of claim 11 wherein said hole on said slope portion is a slot having a contour and a size adapted to accept said second end with a flat shape.

14. A packaging item as in claim 11 wherein said hole on said slope portion is generally round, and is adapted to accept said second end with an elongate shape.

15. A package for holding a product having a first end and a second end, said package comprising:

an outer box having a flat back wall;

an one-piece inner packaging item with a size adapted to be snugly accommodated inside said outer box, comprising an one-piece plate having a shoulder portion and a slope portion assuming an acute angle with said shoulder portion;

said shoulder portion being formed with a seat having a flat portion open at a plane that coincides with said flat back wall when said inner packaging item is placed inside said outer box and having a shape and a size adapted to snugly accommodate said first end of said product such that, when said first end of said product is accommodated in said seat, said first end of said product is flush with said plane; and said slope portion having a hole formed therethrough to support said second end of said product inserted through said hole.

16. A package of claim 15 wherein said shoulder portion extends in a first direction, and said one-piece plate further has a base portion extending in a second direction substantially opposite to said first direction for supporting said second end of said product protruding from said hole on said slope portion.

17. A package of claim 15 wherein said one-piece plate is made of a transparent material.

* * * * *